US005276272A

United States Patent [19]

Masuda

[11] Patent Number: 5,276,272

[45] Date of Patent: Jan. 4, 1994

[54] WIND INSTRUMENT SIMULATING APPARATUS

[75] Inventor: Hideyuki Masuda, Hamamatsu, Japan

[73] Assignee: Yamaha Corporation, Hamamatsu, Japan

[21] Appl. No.: 907,877

[22] Filed: Jul. 2, 1992

[30] Foreign Application Priority Data

Jul. 9, 1991 [JP] Japan ..... 3-168507

[51] Int. Cl.[5] ..... G10H 1/00

[52] U.S. Cl. ..... 84/600; 84/477 R; 84/622; 84/630; 84/659

[58] Field of Search ..... 84/622, 630, 659, 660, 84/661, 600, 601, 477 DIG. 9, DIG. 10

[56] References Cited

U.S. PATENT DOCUMENTS

| | | | |
|---|---|---|---|
| 4,868,869 | 9/1989 | Kramer | 84/622 X |
| 4,984,276 | 1/1991 | Smith | 84/630 X |
| 5,027,689 | 7/1991 | Fujimori | 84/622 |
| 5,113,743 | 5/1992 | Higashi | 84/622 |
| 5,117,729 | 6/1992 | Kunimoto | 84/660 |
| 5,131,310 | 7/1992 | Kunimoto | 84/622 X |
| 5,140,888 | 8/1992 | Ito | 84/723 |
| 5,144,096 | 9/1992 | Kunimoto | 84/659 |
| 5,157,214 | 10/1992 | Nakanishi et al. | 84/622 |
| 5,179,242 | 1/1993 | Usa | 84/DIG. 9 X |
| 5,182,415 | 1/1993 | Kunimoto | 84/660 |
| 5,192,825 | 3/1993 | Kunimoto | 84/661 |
| 5,192,826 | 3/1993 | Aoki | 84/662 X |
| 5,200,568 | 4/1993 | Fukushima et al. | 84/622 X |

*Primary Examiner*—William M. Shoop, Jr.
*Assistant Examiner*—Jeffrey W. Donels
*Attorney, Agent, or Firm*—Graham & James

[57] ABSTRACT

In order to simplify the input operations for the simulation of the non-electronic musical instrument such as the wind instrument, input values are visually displayed on a display screen of a display unit. Herein, by operating an input device such as a keyboard, a mouse, a light pen and the like, a tube shape, position and size of a tone hole of the wind instrument is visually drawn on the display screen in accordance with the predetermined plotting programs. In order to simplify calculations required for the computer simulation, the tube shape of the wind instrument, such as a conical shape, is divided into plural portions, each of which is simulated by another simple shape, such as a cylindrical shape. Then, parameters defining the simulated shape of each portion of the tube shape are generated in accordance with the predetermined algorithm, and these parameters are memorized in a memory. When performing a music by use of a wind-instrument-type performance input device, the corresponding parameters are automatically read from the memory so that simulated sounds of the wind instrument can be generated from the electronic musical instrument.

13 Claims, 18 Drawing Sheets $$Ki = \frac{\phi_{i-1}^2 - \phi_i^2}{\phi_{i-1}^2 + \phi_i^2}$$

$$Ki = \frac{\phi_{i-1}^2 - \phi_i^2}{\phi_{i-1}^2 + \phi_i^2}$$

$$\alpha_i = \frac{2\phi_{i-1}^2}{\phi_{i-1}^2 + \phi_i^2}$$

$$\beta_i = \frac{2\phi_i^2}{\phi_{i-1}^2 + \phi_i^2}$$

$$\begin{cases} \alpha_i = \dfrac{2\phi_{i-1}^2}{\phi_{i-1}^2 + \phi_i^2 + \psi_i^2} \\[2ex] \beta_i = \dfrac{2\phi_i^2}{\phi_{i-1}^2 + \phi_i^2 + \psi_i^2} \\[2ex] \gamma_i = \dfrac{2\psi_i^2}{\phi_{i-1}^2 + \phi_i^2 + \psi_i^2} \end{cases}$$

WIND INSTRUMENT SIMULATING APPARATUS

BACKGROUND OF THE INVENTION

1. Field of the Invention

The present invention relates to an electronic musical instrument which simulates sounds of non-electronic musical instruments so as to electronically synthesize musical tones.

2. Prior Art

Recently, several kinds of analyses are made on the vibrating mechanism of the woodwind instrument having a single reed, such as the clarinet having a simple shape of the tube portion. Accompanied with the development of the digital signal processing techniques in these days, it becomes possible to perform the real-time simulation on the vibrating mechanism of the woodwind instrument by use of the digital signal processor (i.e., DSP), which is disclosed in Japanese Patent Laid-Open Publication No. 63-40199, for example.

Meanwhile, when simulating the mechanism of the wind instrument by use of the physical-model sound source, it must be necessary to determine some parameters for the wind instrument to be simulated. For example, when simulating the clarinet, it is necessary to determine several kinds of parameters which define the shape of the clarinet, shape and size of the tone holes and characteristics of the reed. However, complicated operations and a large number of computing operations must be needed to determine such parameters, which is very troublesome.

SUMMARY OF THE INVENTION

It is accordingly an object of the present invention to provide an electronic musical instrument to which the performer can input the parameters required for simulating the non-electronic musical instrument in visual manner.

In an aspect of the present invention, there is provided an electronic musical instrument comprising: a sound source which generates a musical tone signal on the basis of parameters and predetermined algorithms; an input portion which arbitrarily inputs a shape condition defining a shape of each portion of the instrument to be simulated; a modifying portion which modifies the inputted shape condition; a display portion which visually displays at least one of the shapes corresponding to the inputted shape condition and modified shape condition; and a parameter generating portion which generates the parameters in response to the modified shape condition so as to supply the parameters to the sound source.

When drawing shapes of the tube and tone hole of the wind instrument to be simulated by use of the display portion, the parameter generating portion automatically generates the parameters corresponding to the drawn shapes. Thus, the sound source generates a musical tone corresponding to the instrument of which shape is displayed by the display portion.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings.

DESCRIPTION OF THE PREFERRED EMBODIMENTS

Figure 1:
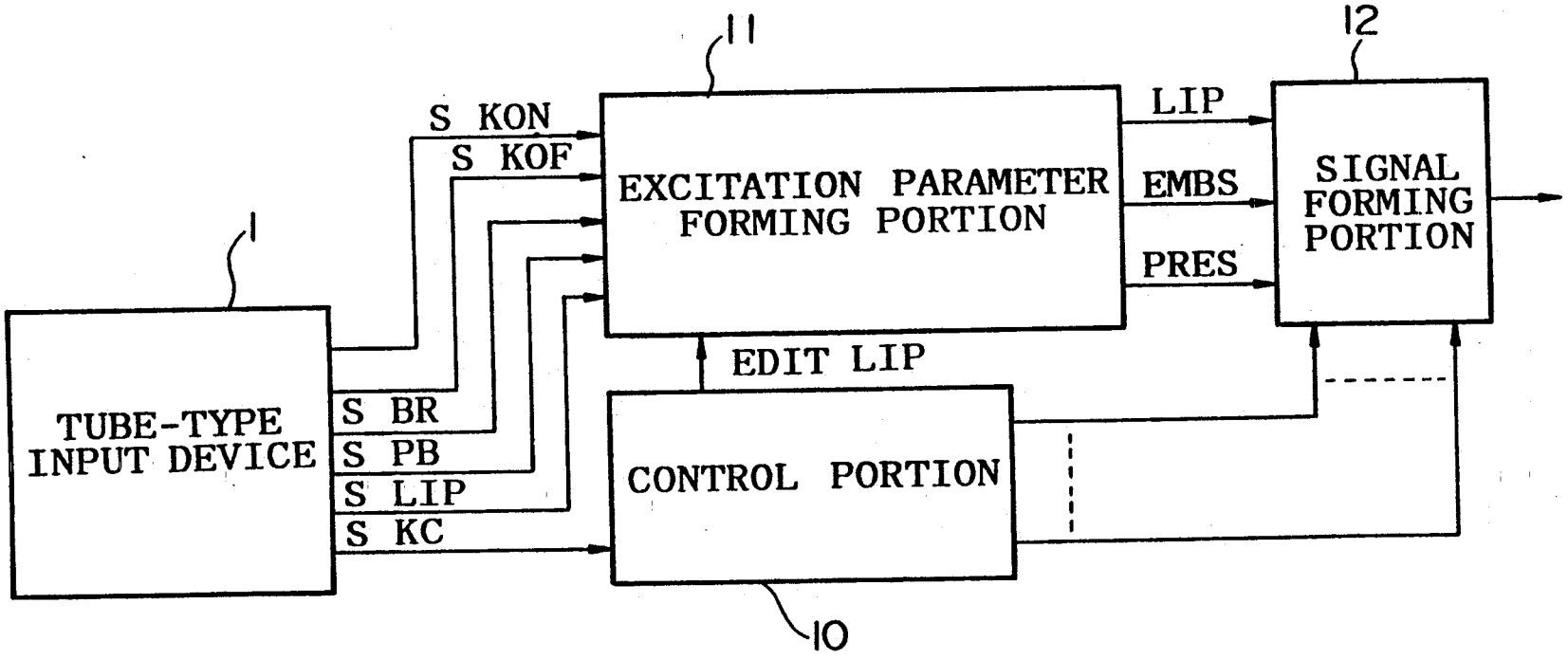
FIG. 1 is a block diagram showing a whole configuration of an electronic musical instrument according to an embodiment of the present invention.

Next, description will be given with respect to an embodiment of the present invention by referring to the drawings.

[A] Configuration of Embodiment

Figure 2:
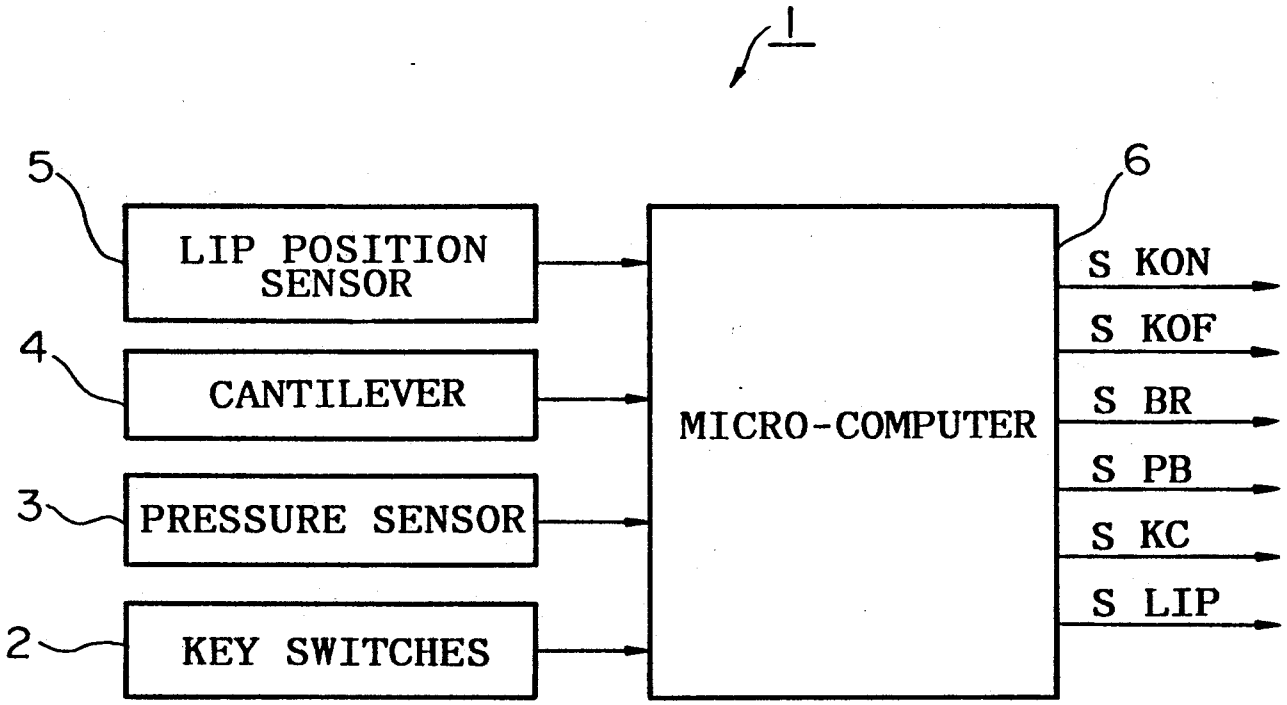
FIG. 2 is a block diagram showing a detailed configuration of a tube-type input device shown in FIG. 1.
Figure 3:
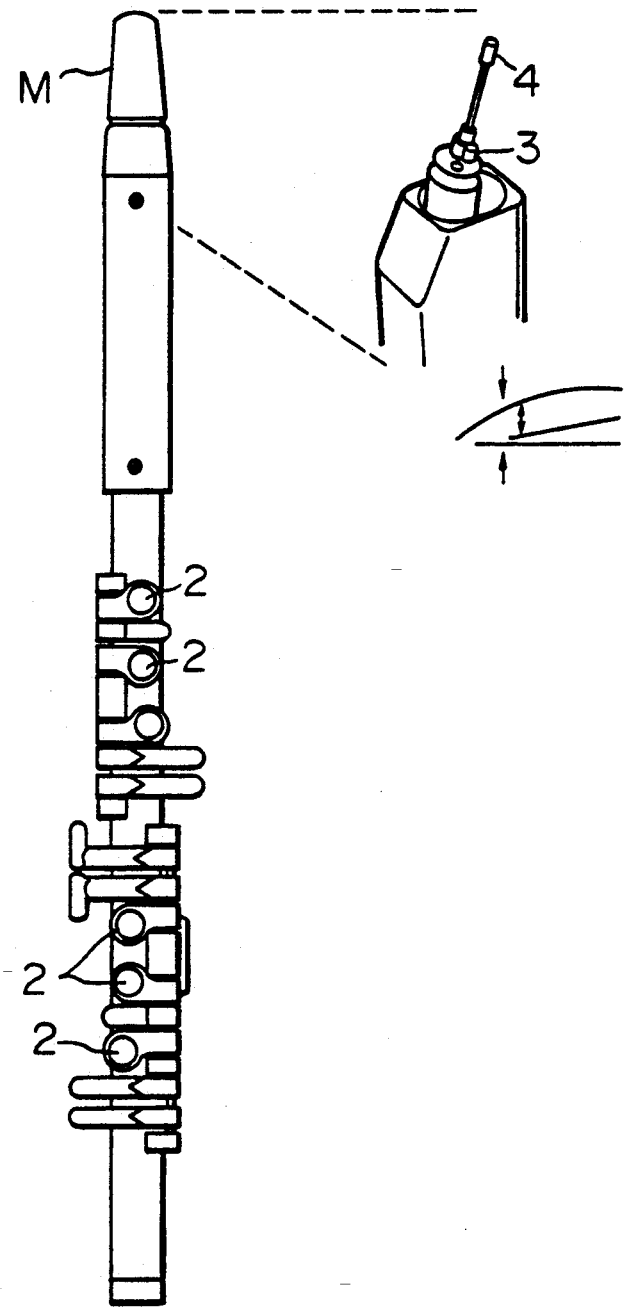
FIG. 3 is a front view illustrating an appearance of the tube-type input device.

FIG. 1 is a block diagram showing the overall system configuration of the electronic musical instrument according to an embodiment of the present invention. In FIG. 1, 1 designates a tube-type performance input device having a shape which resembles the wind instrument. In response to the operations made by the performer, this tube-type performance input device 1 outputs several kinds of signals, which will be described later. Herein, FIG. 2 shows an electric configuration of this device 1, while FIG. 3 illustrates the appearance of this device 1. In FIGS. 2 and 3, 2 designates key switches which are operated by the fingers of the performer, while 3 designates a pressure sensor, equipped in a mouthpiece M, which detects the breathing intensity of the performer. In addition, 4 designates a cantilever which detects the pressure (which is called as "Embouchure pressure") applied to the reed when the performer puts the mouthpiece at his mouth, while 5 designates a lip position sensor (not shown in FIG. 3) which detects the position of the lips of the performer. The outputs of the above-mentioned switches and sensors are supplied to a micro-computer 6 shown in FIG. 2, in which the corresponding signals are generated.

The micro-computer 6 generates the following signals:

S KON: a signal, representing the start timing of the tone-generation, which is generated when the detection value of the pressure sensor 3 exceeds the predetermined value.

S KOF: a signal, representing the suspension of the tone-generation, which is generated when the detection value of the pressure sensor 3 becomes lower than the predetermined value.

S PB: a signal, representing the amount of the Embouchure pressure, which is generated on the basis of the output signal of the cantilever 4.

S BR: a signal, representing the breathing intensity of the performer, which is generated on the basis of the output signal of the pressure sensor 3.

S KC: a signal, representing the pitch of the musical tone to be generated, which is outputted in response to the operation of the key switch 2.

S LIP: a signal, representing the position of the lips of the performer, which is generated on the basis of the output signal of the lip position sensor 5.

Figure 5:
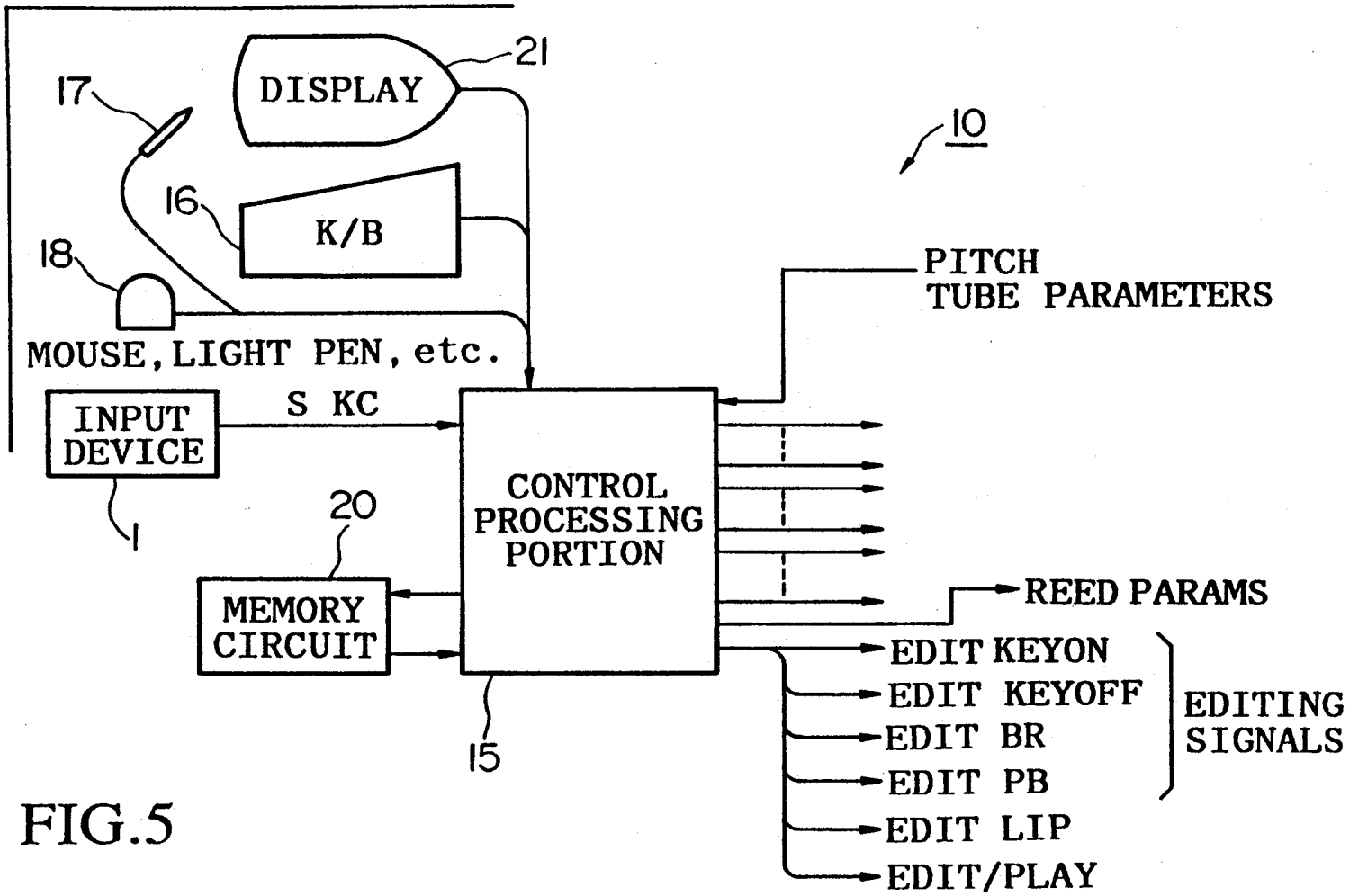
FIG. 5 is a block diagram showing a detailed configuration of a control portion shown in FIG. 1.

Among the above-mentioned signals, the signal SKC is only supplied to a control portion 10, while the other signals are supplied to an excitation parameter forming portion 11. The control portion 10 is configured as shown in FIG. 5, wherein it generates tube parameters for tube models (which will be described later) provided in a signal forming portion 12. In FIG. 5, 15 designates a control processing portion which performs generation and control on several kinds of signals, wherein this portion 15 is configured by a central processing unit (CPU) and its peripheral circuits (not shown). Each of a keyboard 16, a light pen 17 and a mouse 18 is designed to output its designation signal to the control processing portion 15. The contents of the designation signals are displayed by a display unit 21. Further, 20 designates a memory circuit which stores several kinds of data and programs used for generating the parameters. Among output signals of the control processing portion 15, "EDIT KEYON", "EDIT KEYOFF", "EDIT BR", "EDIT PB", "EDIT LIP" are editing signals respectively corresponding to the foregoing signals SKON, SKOF, SBR, SPB, SLIP. In addition, a signal "EDIT/-PLAY" is used to switch over the performance mode between the edit mode and play mode, while another signal "REED PARAMS" correspond to a group of data which define the reed characteristic.

Figure 4:
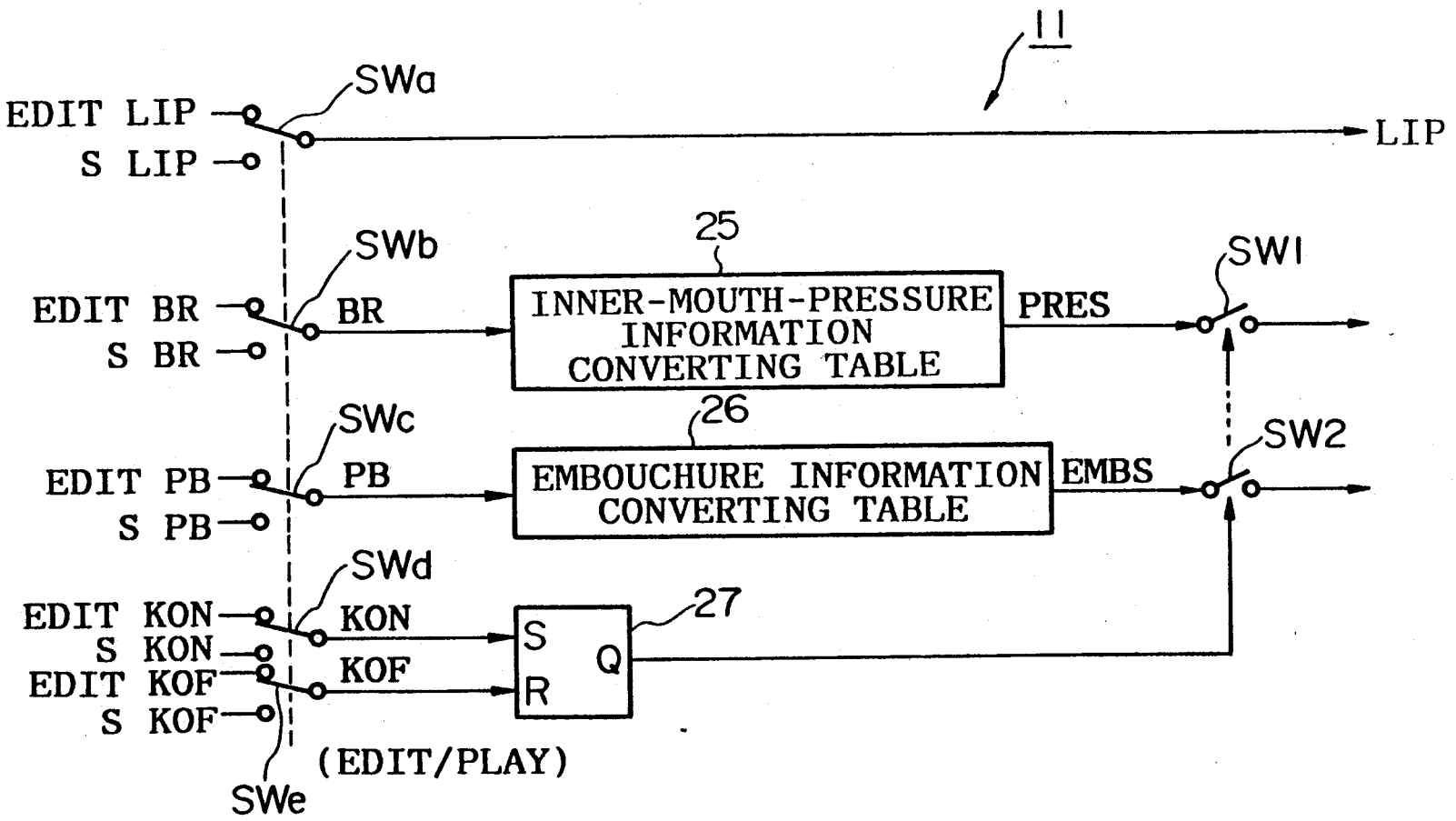
FIG. 4 is a block diagram showing a detailed configuration of an excitation parameter forming portion shown in FIG. 1.

Next, description will be given with respect to the excitation parameter forming portion 11 by referring to FIG. 4. In FIG. 4, switches SWa to SWe are interconnected to each other, and they are switched over to select either the output signals of the key switches 2, sensors 3, 4, 5 or the editing signals outputted from the control processing portion 15. These switches SWa to SWe are switched in response to the signal EDIT/-PLAY. One of two signals is selected by each of the switches SWa-SWe, and the selected signals of these switches SWa, SWb, SWc, SWd, SWe are respectively outputted as signals LIP, BR, PB, KON, KOF. Then, an inner-mouth-pressure information converting table 25 converts the signal BR (i.e., either EDIT BR or SBR) into a signal PRES on the basis of the present contents thereof. In addition, an Embouchure information converting table 26 converts the signal PB (i.e., either EDIT PB or SPB) into a signal EMBS on the basis of the preset contents thereof. Further, 27 designates a flip-flop in which the signal KON is inputted to its set terminal "S" and the signal KOF is inputted to its reset terminal "R". The output "Q" of this flip-flop 27 is supplied to switches SW1, SW2 as their switching signal. In this case, these switches SW1, SW2 are both at the on-state when the output Q is at "1", while they are both at the off-state when the output Q is at "0". In short, when the flip-flop 27 is in the set-state by the signal KON, the signals PRES, EMBS are supplied to the signal forming portion 12. Incidentally, it is possible to remove this flip-flop 27 from the circuitry shown in FIG. 4 so that the signals PRES, EMBS are always supplied to the signal forming portion 12.

Figure 6:
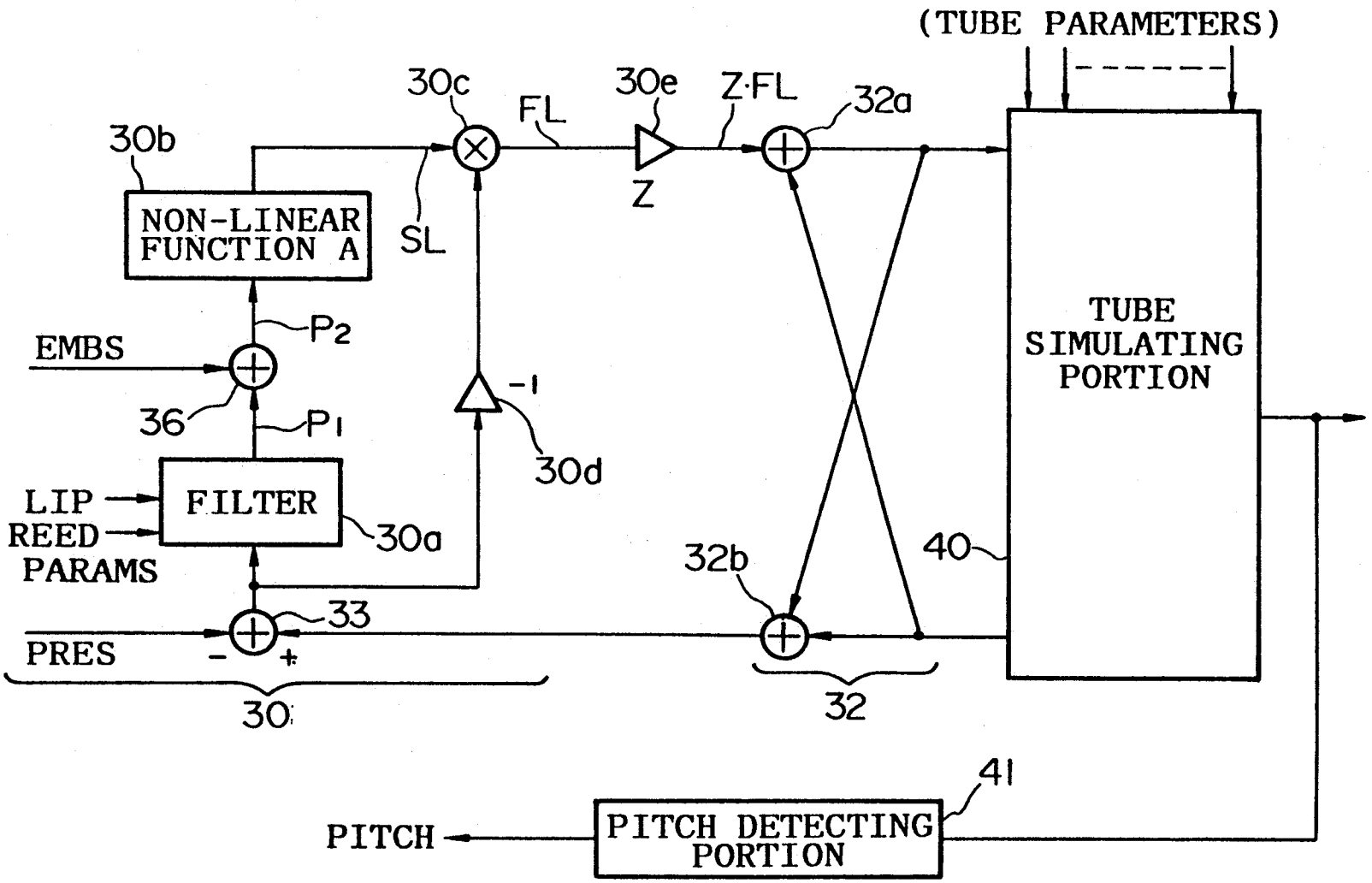
FIG. 6 is a block diagram showing a detailed configuration of a signal forming portion shown in FIG. 1.

Next, description will be given with respect to the signal forming portion 12 by referring to FIG. 6. Herein, 30 designates an excitation-vibration circuit which contains a subtracter 33, a filter **30*a*, an adder 36, a non-linear function ROM 30*b*, multipliers 30*c*, 30*e* and an inverter 30*d*. This excitation-vibration circuit 30 is designed to simulate the excitation-vibration portion of the wind instrument including the reed. In addition, 32 designates a junction portion consisting of adders 32*a*, 32*b*. Further, 40 designates a tube simulating portion which is designed to simulate the resonance tube of the wind instrument. Furthermore, a pitch detecting portion 41 detects the pitch from the musical tone signal outputted from the tube simulating portion 40 so as to output a pitch signal PITCH toward the foregoing control processing portion 15**.

In the junction portion 32, the adder **32*a* adds the outputs of the multiplier 30*e* and tube simulating portion 40 together, and the addition result is supplied to the tube simulating portion 40. Similarly, the adder 32*b* adds the outputs of the adder 32*a* and tube simulating portion 40 together, and the addition result is supplied to the subtracter 33**. Thus, it is possible to simulate the scattering manner of the air-pressure wave which is occurred at the junction formed between the tube and reed of the resonance tube.

The subtracter 33 receives the signal PRES corresponding to the blowing pressure applied to the wind instrument as the subtracting signal. The output data of this subtracter 33 represents the air pressure at the gap between the mouthpiece and reed. The filter **30*a* is designed to simulate the movement of the reed, and it performs the band-restriction filtering operation on the input thereof. Such band-restriction filtering operation enables this circuitry to simulate the follow-up characteristic of the reed with respect to the pressure variation. According to such follow-up characteristic of the reed, when the pressure variation is applied to the reed, displacement of the reed may be delayed because of the inertia of the reed. Further, as the frequency of the pressure variation becomes higher, response of the reed becomes weaker. Incidentally, the filter characteristic of the filter 30*a*** is varied in response to the signals LIP, REED PARAMS, which will be described later.

The output data P1 of the filter **30*a* is added with the signal EMBS representing the Embouchure pressure by the adder 36, from which the data P2 corresponding to the pressure actually applied to the reed is outputted. By the non-linear function memorized in the ROM 30*b*, this data P2 is converted into data SL corresponding to the sectional area of the gap between the mouthpiece and reed. This data SL is multiplied by the output of the inverter 30*d* by the multiplier 30*c*, of which multiplication result FL (corresponding to the actual air-flow velocity at the reed) is supplied to the multiplier 30***e*. Then, the multiplier 30*e* multiplies this signal FL by the impedance Z corresponding to the tube characteristic. Thereafter, the multiplication result, i.e., pressure variation component Z*FL is supplied to the adder 32*a*.

Next, description will be given with respect to the tube simulating portion 40. In the present system, there are provided some algorithms for several kinds of shapes of the tubes of the wind instruments to be simulated. In the present embodiment, three of these algorithms will be described.

Figure 7:
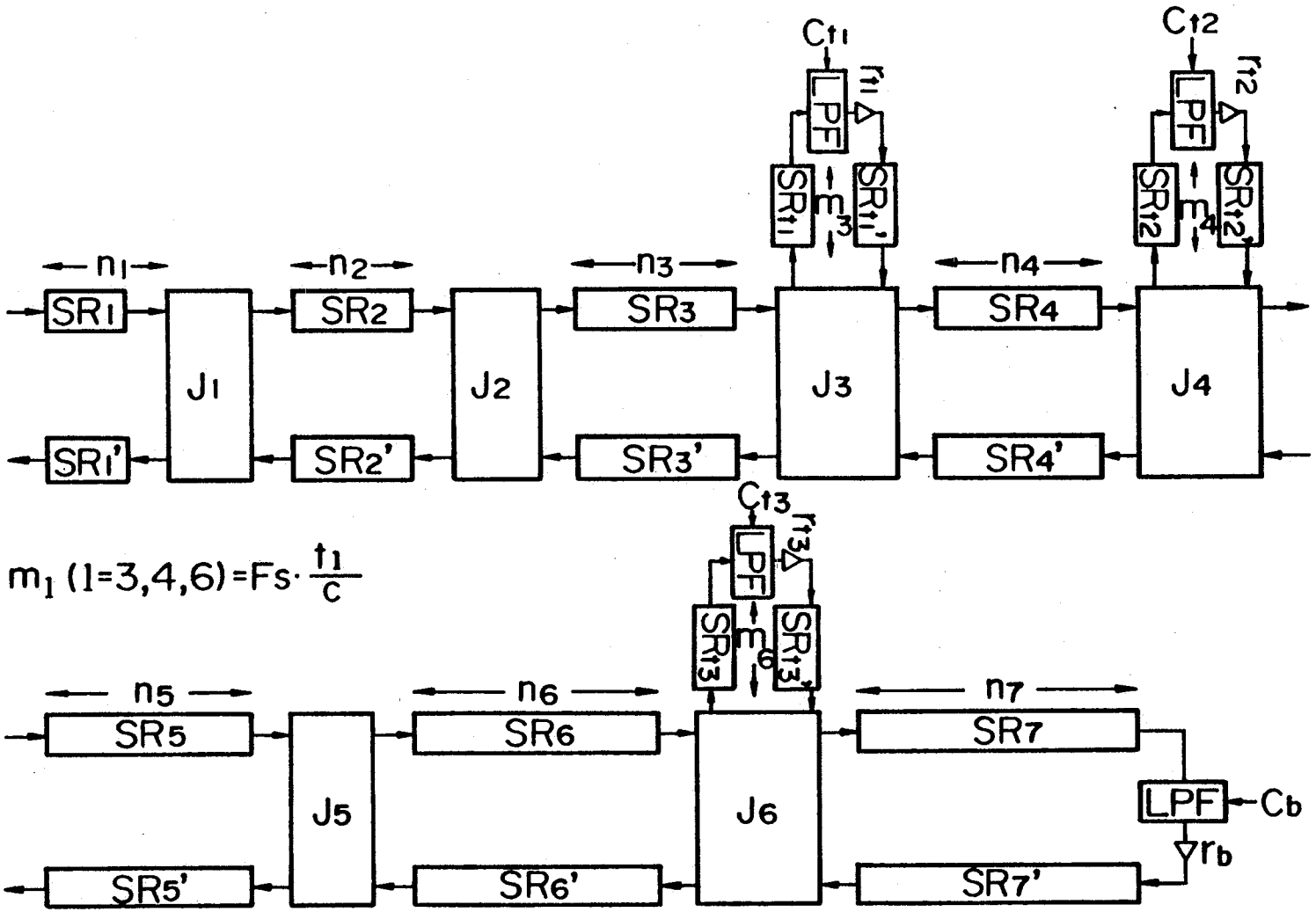
FIG. 7 is a block diagram representing a first algorithm to be used in a tube simulating portion shown in FIG. 6.

FIG. 7 shows the circuitry simulating the tube in accordance with the first algorithm. This algorithm simulates the combination of the open/close states (containing partial-open/close states) of all of the tone holes and register tubes, and it can also simulate the operations and characteristics of the tube having an arbitrary shape. In other words, this algorithm embodies most of the operations and characteristics of the acoustic instrument.

In FIG. 7, numerals "SR" accompanied with suffix numbers represent the shift registers, which simulate the propagation delay of the air-pressure wave to be transmitted in the tube. Numerals "J" accompanied with suffix numbers represent the junctions, which simulate the scattering of the air-pressure wave to be occurred at the positions at which the diameter of the tube is changed. Numerals "LPF" represent the low-pass filters, which simulate the energy loss to be occurred when the air-pressure wave is reflected by the end-terminal portion of the tube.

Figure 8A:
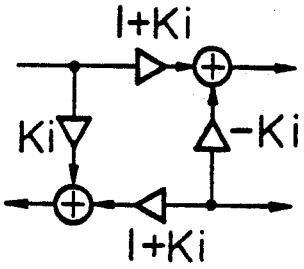
FIG. 8(*a*) to 8(*c*) are circuit diagrams each showing a circuit example of a junction used in FIG. 7.
Figure 8B:
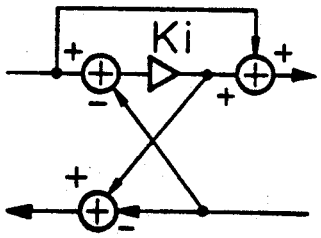
Figure 8C:
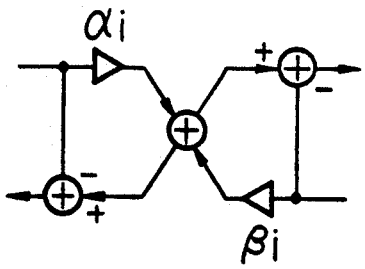
Figure 9:
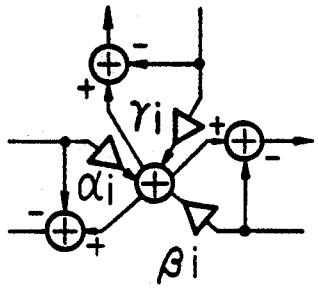
FIG. 9 is a circuit diagram showing another circuit example of another junction used in FIG. 7.
Figure 10:
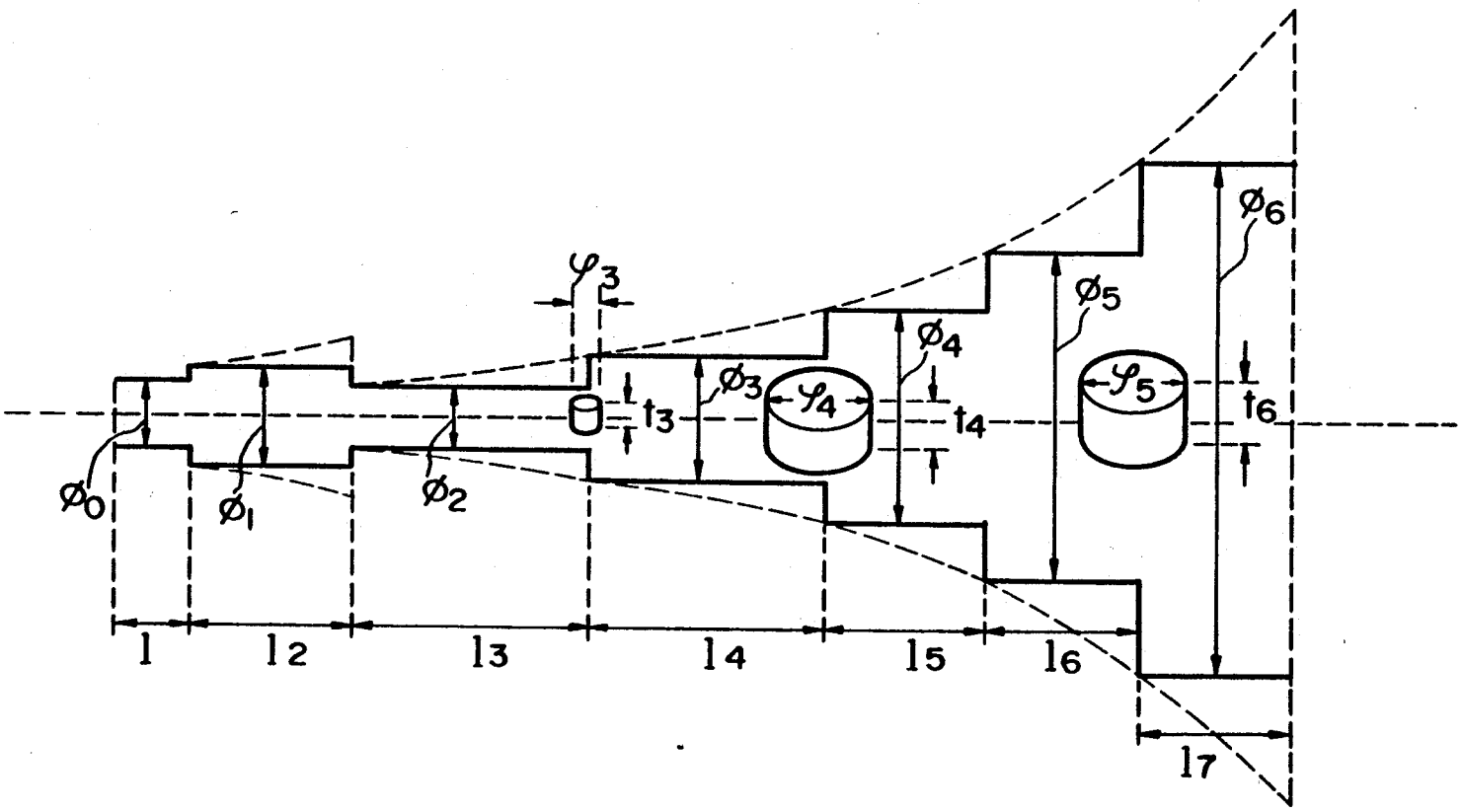
FIG. 10 shows a rough construction of a tube shape to be simulated by the first algorithm.

In the circuitry shown in FIG. 7, each of the junctions J1, J2, J5 corresponds to the junction (e.g., two-port junction) at which no tone hole is formed but some stage difference is formed. Such junction can be configured by any one of circuits shown in FIGS. 8(*a*), 8(*b*), 8(*c*). On the other hand, each of the junctions J3, J4, J6 corresponds to the junction (e.g., three-port junction) at which the tone hole having certain height is formed. The configuration of this junction is as shown in FIG. 9. The first algorithm as shown in FIG. 7 simulates the tube shape, as shown in FIG. 10, which is formed by plural cylindrical portions each having a different diameter. It can be easily understood from these drawings that parameters $\alpha$, $\beta$, $\gamma$ used in the algorithm depend on diameter $\phi$ at each portion of the tube (i.e., diameter $\phi$ of each tone hole), while height t such as t3, t4, t6, is used to determine the number of stages, such as m3, m4, m6, of the shift register. In addition, the delay time of the shift register SR corresponds to the length $\iota$ of each tube portion shown in FIG. 10. Further, the open/close state of the tone hole is reflected to parameters rt1, rt2, rt3, each of which turns to a negative value in the open state but turns to a positive value in the close state.

As described above, each parameter determining the simulation manner of the tube simulating portion 40 depends on the shape of each tube portion. The above-mentioned parameters $\alpha$, $\beta$, $\gamma$ are the tube parameters to be outputted from the foregoing control processing portion 15 (see FIG. 5). In other words, they are created on the basis of the shape of the tube which is judged by the control processing portion 15.

Incidentally, this algorithm can arbitrarily set whether or not the tone hole is formed at the junction.

Figure 11:
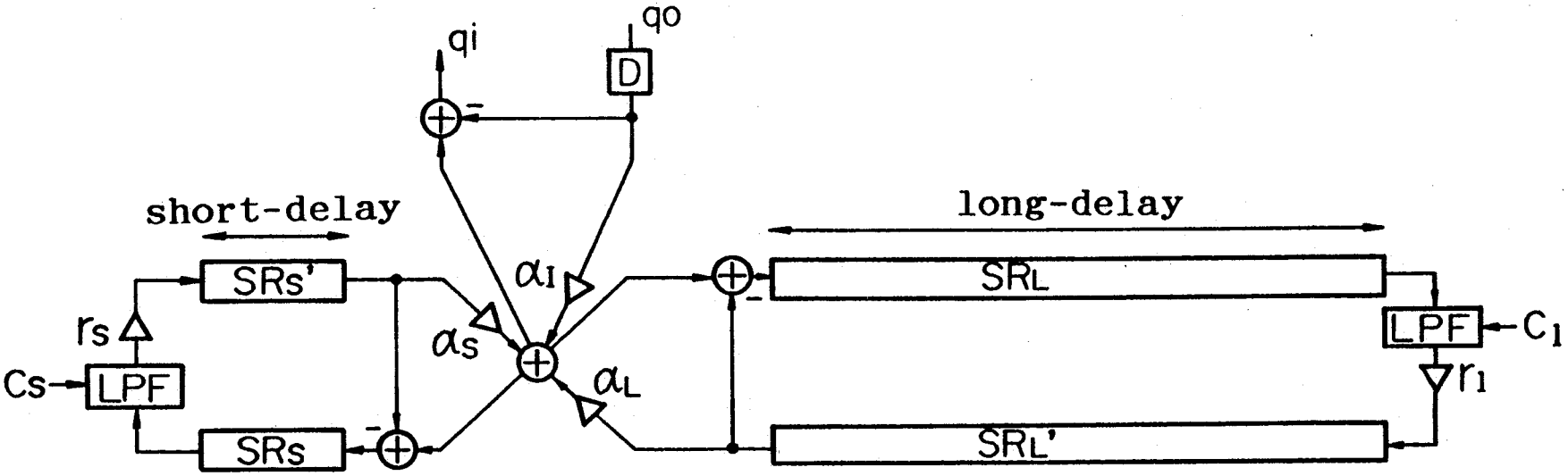
FIG. 11 is a block diagram representing a second algorithm.

Next, FIG. 11 shows the circuitry corresponding to the second algorithm. This is the model which has no tone hole, wherein the tone-generation frequency is determined by the length reaching the end terminal portion of the tube. As comparing with the foregoing first algorithm, this second algorithm can control the pitch with ease. In general, this model can be embodied by the first circuit configuration in which two-port wave guide networks (WGN) are connected together by the cascade-connection manner or the second circuit configuration in which only one conical portion of the tube is simulated by a simple wave guide network. FIG. 11 is made on the basis of the second circuit configuration.

This model as shown in FIG. 11 is made on the basis of the approximate expression for the input acoustic impedance of the conical portion, wherein it is made by connecting two cylindrical portions in parallel by use of the wave guide network. Even in this second algorithm, several kinds of parameters are calculated in accordance with the tube shape. In short, as similar to the foregoing first algorithm, these parameters are outputted from the control processing portion 15 as the tube parameters.

Figure 12:
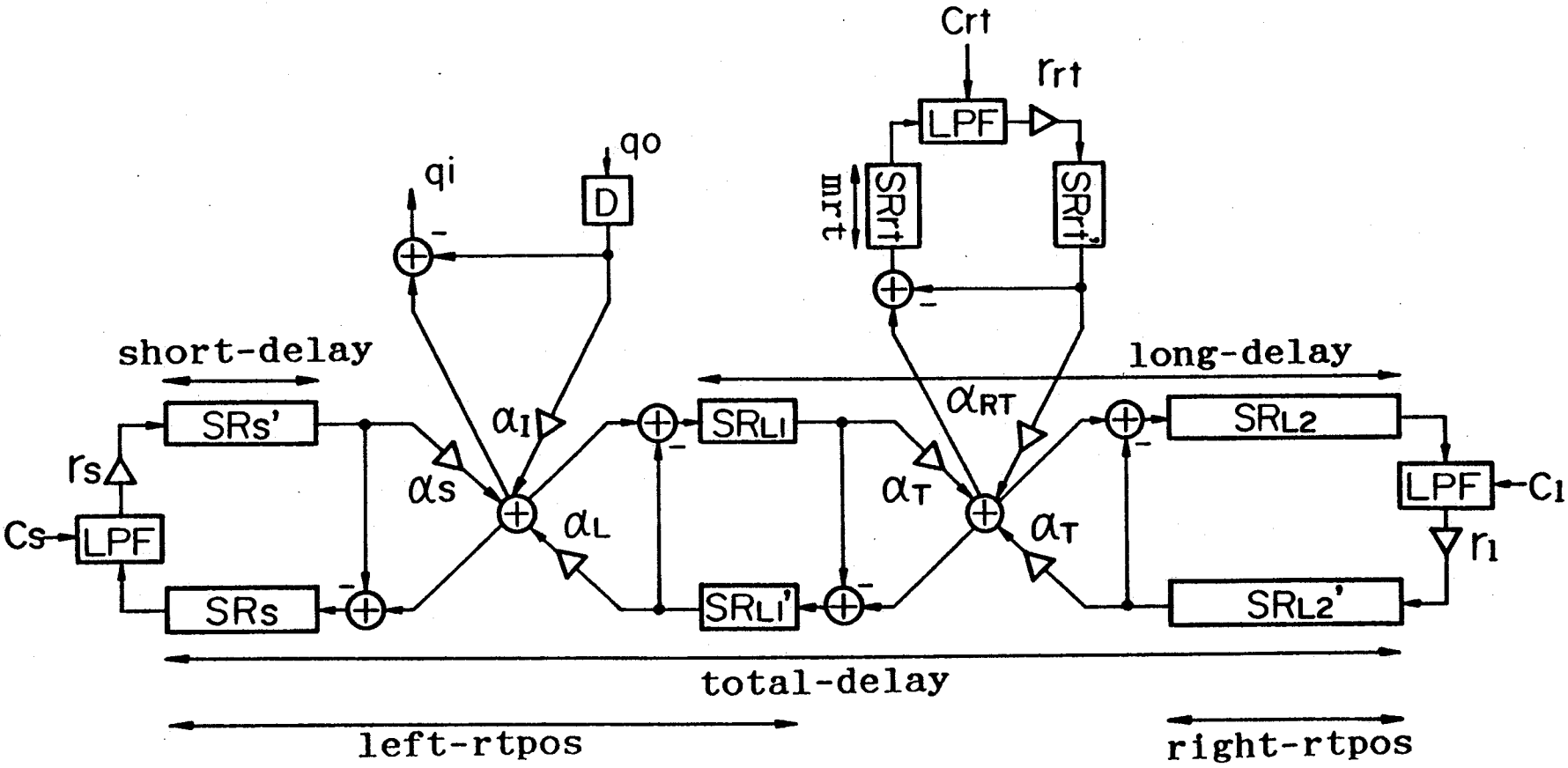
FIG. 12 is a block diagram representing a third algorithm.

Next, FIG. 12 shows the circuitry corresponding to the third algorithm. In FIG. 12, "left-rtpos" represents the delay amount of the left-side portion of the tube from the tone hole, while "right-rtpos" represents the delay amount of the right-side portion of the tube. Therefore, sum of these delay amounts is set equal to the total delay amount represented by "total-delay" in FIG. 12. This model is characterized by introducing the register tube into the circuitry shown in FIG. 11. As similar to the foregoing algorithms, the tube parameters of this third algorithm are calculated by the control processing portion 15.

[B] Operation of Embodiment

Next, description will be given with respect to the operations of the present embodiment.

Figure 13:
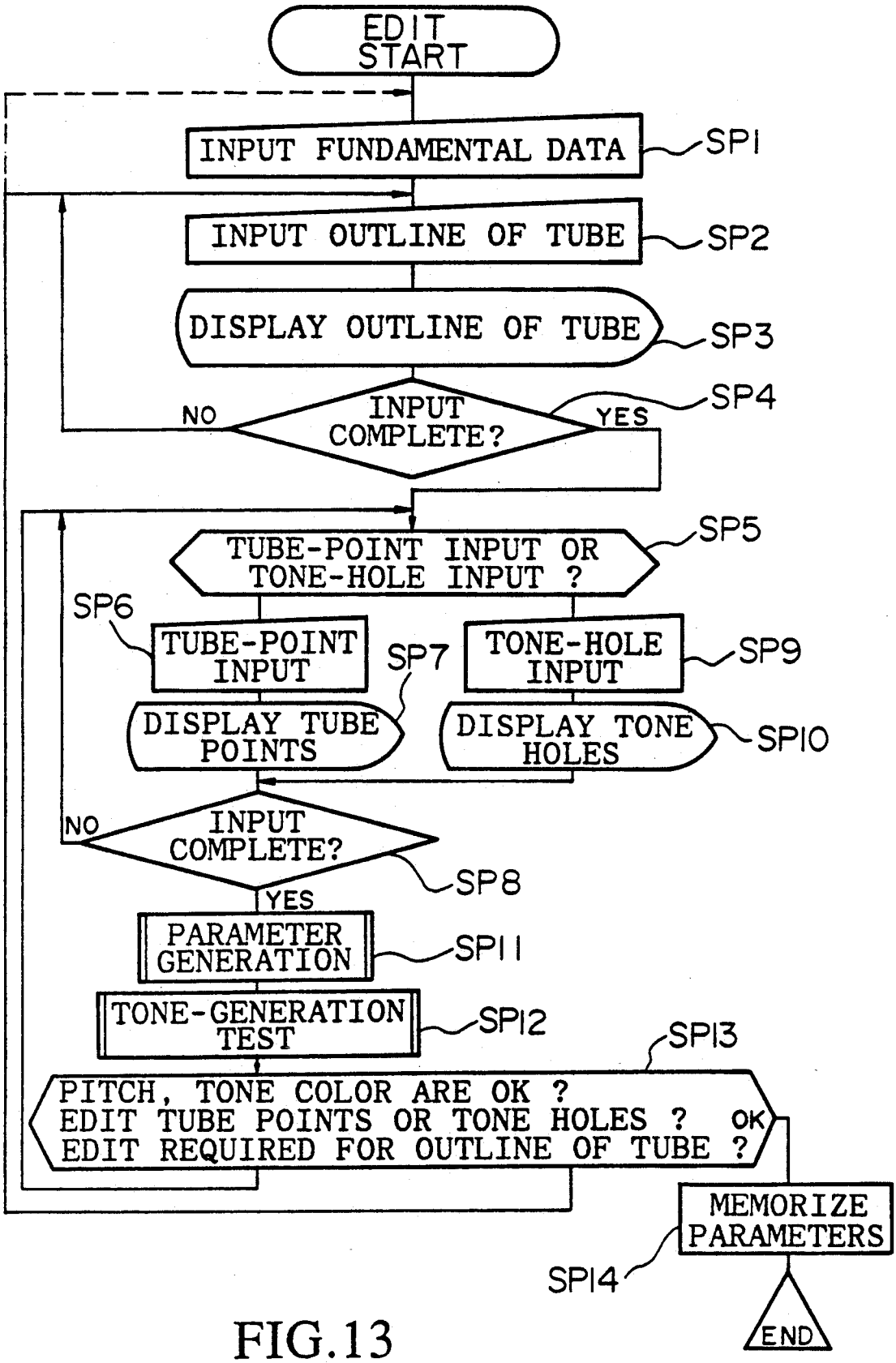
FIG. 13 is a flowchart showing operations of the embodiment.

At first, when the edit mode is set by operating certain key of the keyboard 16, the switches SW1-SWe are switched over to the edit-side, so that processes of the flowchart as shown in FIG. 13 are started to be executed.

In first step SP1 of this flowchart shown in FIG. 13, some fundamental data are inputted into the system. Herein, the fundamental data correspond to the designed pitch, number of divided portions of the tube (i.e., number of junctions), number of tone holes, whole length of the tube and the like. The designed pitch is used for the editing operation, wherein it is set at A3 note (i.e., "1*a*"), for example. Next, through processes of steps SP2, SP3, the input operation is carried out with respect to the outline of the tube, which is displayed by the display unit 21. Such outline input operation is carried out by the operator who operates the keyboard 16, light pen 17 and mouse 18 while looking at the display image of the display unit 21.

Figure 14:
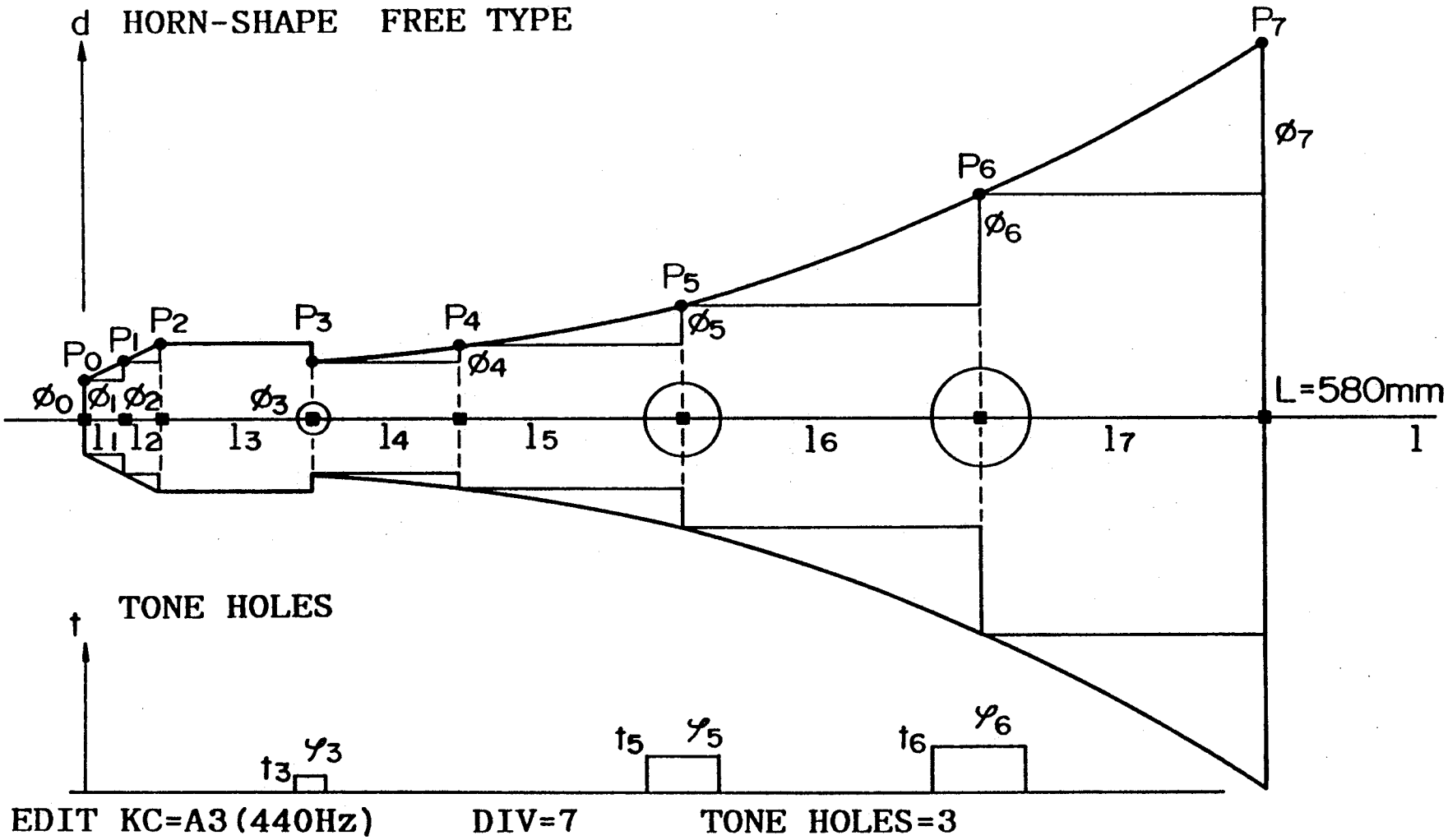
FIGS. 14 and 15 show display examples for the tube simulation.
Figure 15:
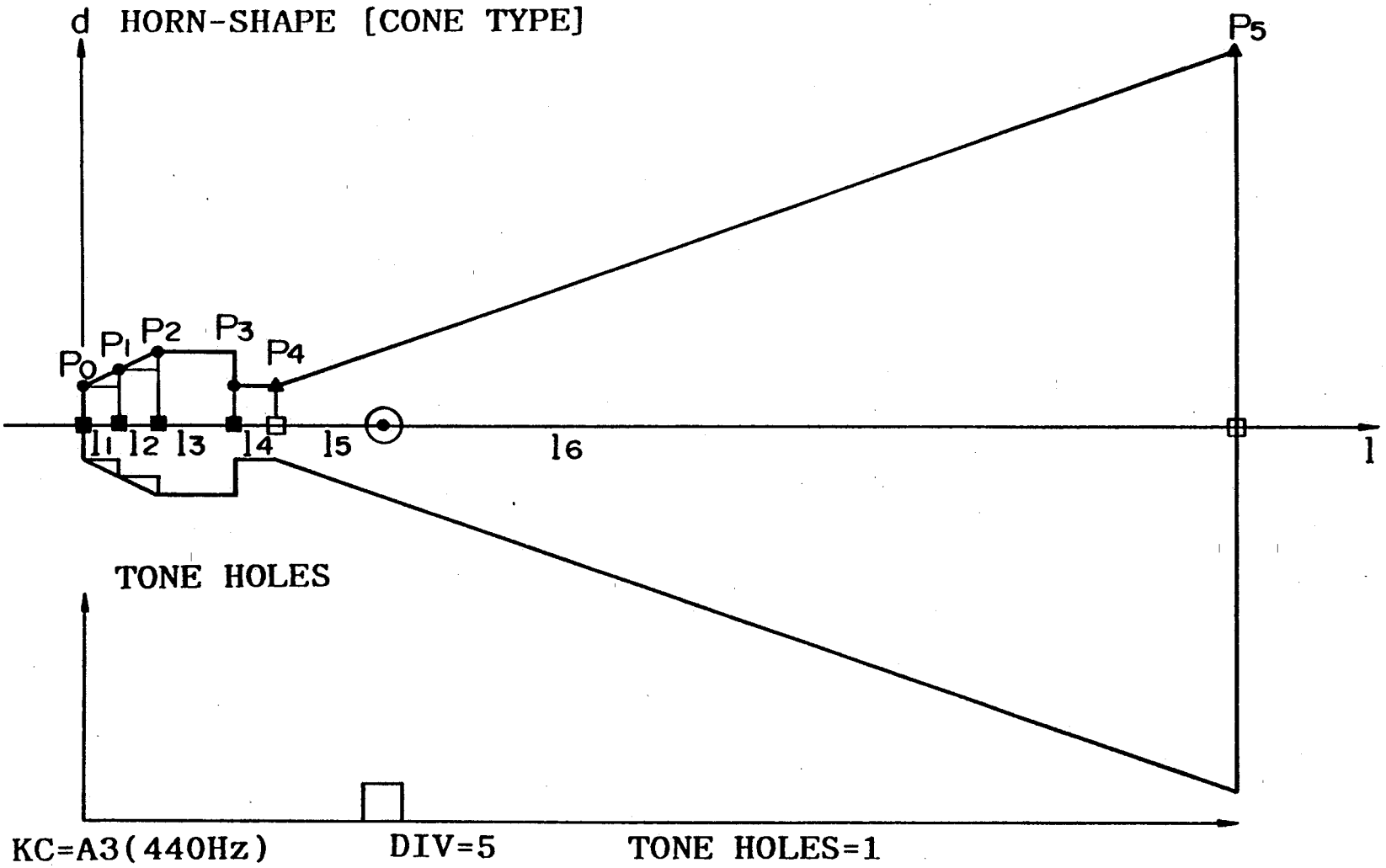

FIG. 14, 15 show examples of the display images of the display unit 21. In these examples, the outline of the tube is drawn by the plotting operation which is made by use of the mouse 18. More specifically, the foregoing memory circuit 20 memorizes the plotting programs (e.g., plotting CAD programs), so that the control processing portion 15 processes the operation made by the operator on the basis of the plotting programs so as to draw the outline of the tube on the display screen of the display unit 21. In the example shown in FIG. 14, the editing pitch is set at A3 note; number of divided tube portions is set at "7"; number of tone holes is set at "3"; and the whole length of the tube is set at 580 mm. In the example shown in FIG. 15, the editing pitch is set at A3 note; number of divided tube portions is set at "5"; and the number of tone holes is set at "1". Incidentally, FIG. 15 shows an example of the simple conical-shape tube in which the portion sandwiched between arrows P4, P5 is formed in the conical shape. Since judgement result of step SP4 is remained at "NO" until the input operation for drawing the outline of the tube is completed, the processes of steps SP2, SP3 are repeated.

In next step SP5, it is judged whether the input operation concerns with the tube-point input or tone-hole input. When the tube-point input is selected, the processing proceeds to step SP6 wherein the system reads the tube points to be inputted thereto. Then, the processing proceeds to step SP7 wherein the tube points are displayed. Thereafter, until the input operation concerning with the tube points is completed, judgement result of step SP8 is remained at "NO", so that the processes of steps SP5, SP6, SP7, SP8 are repeated. In the example shown in FIG. 14, tube points P0 to P7 are inputted. In this case, the diameter $\phi$ is calculated with respect to each of the inputted tube points. Thus, in FIG. 14, the tube shape is simulated and displayed as the combination of seven cylindrical portions each having the calculated point diameter.

On the other hand, when the tone-hole input is selected in step SP5, the system awaits for the setting values of the tone holes to be inputted thereto in step SP9. In next step SP10, the display operation is carried out with respect to the input values. Thereafter, until the input operation concerning with the tone holes is completed, the judgement result of step SP8 is remained at "NO", so that the processes of steps SP5, SP9, SP10, SP8 are repeated. In the example shown in FIG. 14, heights t3, t5, t6 and diameters $\phi$3, $\phi$5, $\phi$6 are respectively set for three tone holes. According to the above-mentioned processes, the operator can input several values for each portion which are necessary to simulate the tube by looking at the display unit 21.

When the above-mentioned input operation is completed, the judgement result of step SP8 turns to "YES", so that the processing proceeds to step SP11 wherein a parameter generating process is executed. In other words, several parameters are generated in accordance with the algorithm corresponding to the tube of which fundamental data etc. are inputted by the above-mentioned input operation.

For example, when the outline of the tube as shown in FIG. 14 is drawn on the display screen of the display unit 21, the foregoing first algorithm is selected. Thus, in response to the diameter at each point Pi (where i=1, 2, . . . ) and tone-hole diameter, the parameters $\alpha$, $\beta$, $\gamma$ (see FIGS. 8, 9) are generated in accordance with the selected first algorithm. In addition, the delay time of the shift register SR (see FIG. 7) is determined in response to the distance between the points (i.e., length of each cylindrical portion), while the number of stages of the shift register (i.e., m3, m4, m6, see FIG. 7) is determined in response to the height of the tone hole. These parameters are supplied from the control processing portion 15 (see FIG. 5) to the tube simulating portion 40 (see FIG. 6) in step SP11.

In accordance with the generated parameters, a tone-generation testing process is carried out in step SP12. At first, the control processing portion 15 outputs the editing signals EDIT KEYON, EDIT KC, EDIT BR, etc. (see FIG. 5). On the basis of these signals, the excitation parameter forming portion 11 outputs the signals LIP, EMBS, PRES. As a result, the signal forming portion 12 generates the musical tone signal corresponding to the foregoing parameters and signals EMBS, PRES. This musical tone signal is sounded as the musical tone by the sound system (not shown). By listening to this musical tone, the operator can judge whether or not the simulation is made well.

If the result of tone-generation is good enough, judgement result of step SP13 turns to "OK", so that the processing proceeds to step SP14 wherein the generated parameters are memorized. Such memorized parameters are read out when the performance mode is selected.

If the operator finds a problem from the result of tone-generation, e.g., if the problem is with the pitch or tone color, it can be said that the tube design (i.e., tube simulation) is not made properly. In such case, the operator will make some corrections. Then, by returning to step SP5 when the tube points are not set properly, or by returning to step SP2 when the outline of the tube is not drawn properly, the foregoing processes are performed again to properly correct them. If the fundamental data are not inputted properly, the processing returns to step SP1 again so that all of the foregoing processes are executed again (see dotted-line route of the processes in FIG. 13).

Thereafter, when the performance mode is selected after the parameters are properly memorized, the signals SLIP, SBR, SPB, SKON, SKOF are selected by operating the switches SWa-SWe shown in FIG. 4. The performer operates the keyboard 16 to read out desirable parameters from the memory circuit 20. As a result, the reed parameters are supplied to the tube simulating portion 40 and filter 30*a* (see "REED PARAMS" in FIG. 6), and several kinds of constants are determined for them.

When the performer performs music by blowing the tube-type performance input device 1, the signal SKON is outputted when the breath pressure exceeds certain threshold value, so that the signal SBR corresponding to the breath pressure is outputted from the excitation parameter forming portion 11. This excitation parameter forming portion 11 also outputs the signal EMBS corresponding to the biting intensity of the mouthpiece M and the signal LIP corresponding to the position at which the performer puts the mouthpiece M at his mouth. Thus, all of the signals required for simulating the mouthpiece are provided in the excitation-vibration circuit 30 (see FIG. 6). As a result, the signal forming portion 12 generates the musical tone signal corresponding to the tube to be simulated. In this case, the keycode KC is generated in response to the operation of the key switch 2 by the performer, so that the control portion 10 supplies the parameter corresponding to it to the tube simulating portion 40. Thus, the musical tone signal outputted from the signal forming portion 12 provides the pitch corresponding to the performance to be actually played.

Figure 16A:
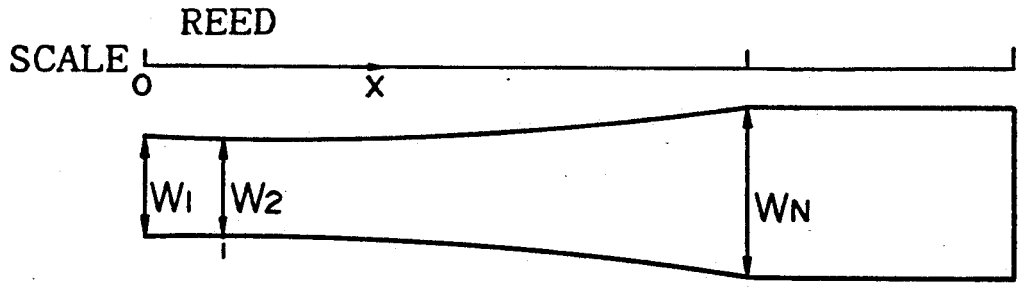
FIGS. 16A and 16B are a top and side view, respectively, of a simulated reed.
Figure 16B:
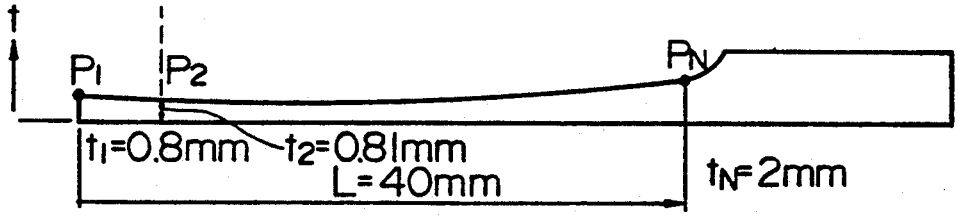
Figure 16C:
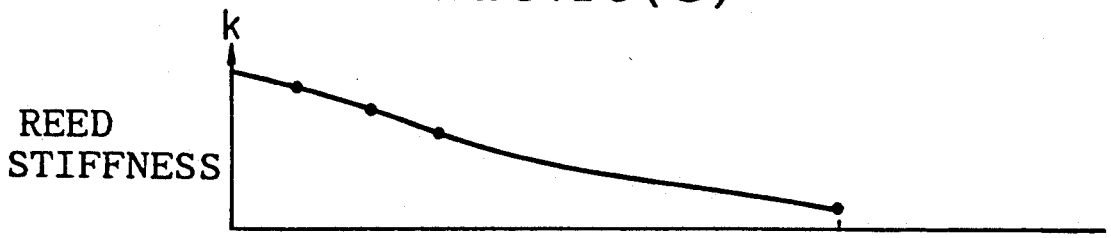
FIG. 16C is a graph representing the stiffness of the reed.
Figure 16D:
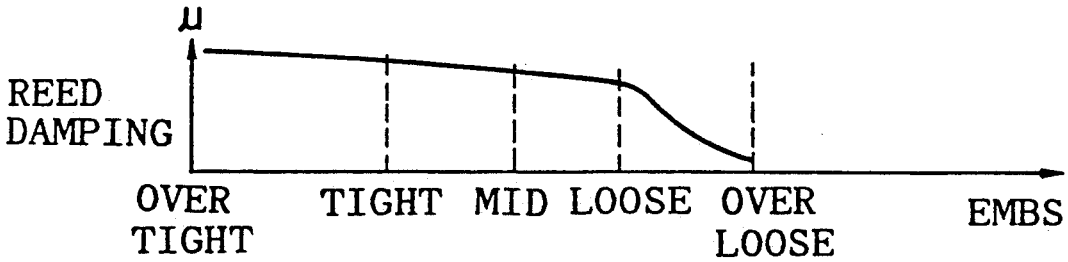
FIG. 16D is a graph representing the damping value of the reed.
Figure 17:
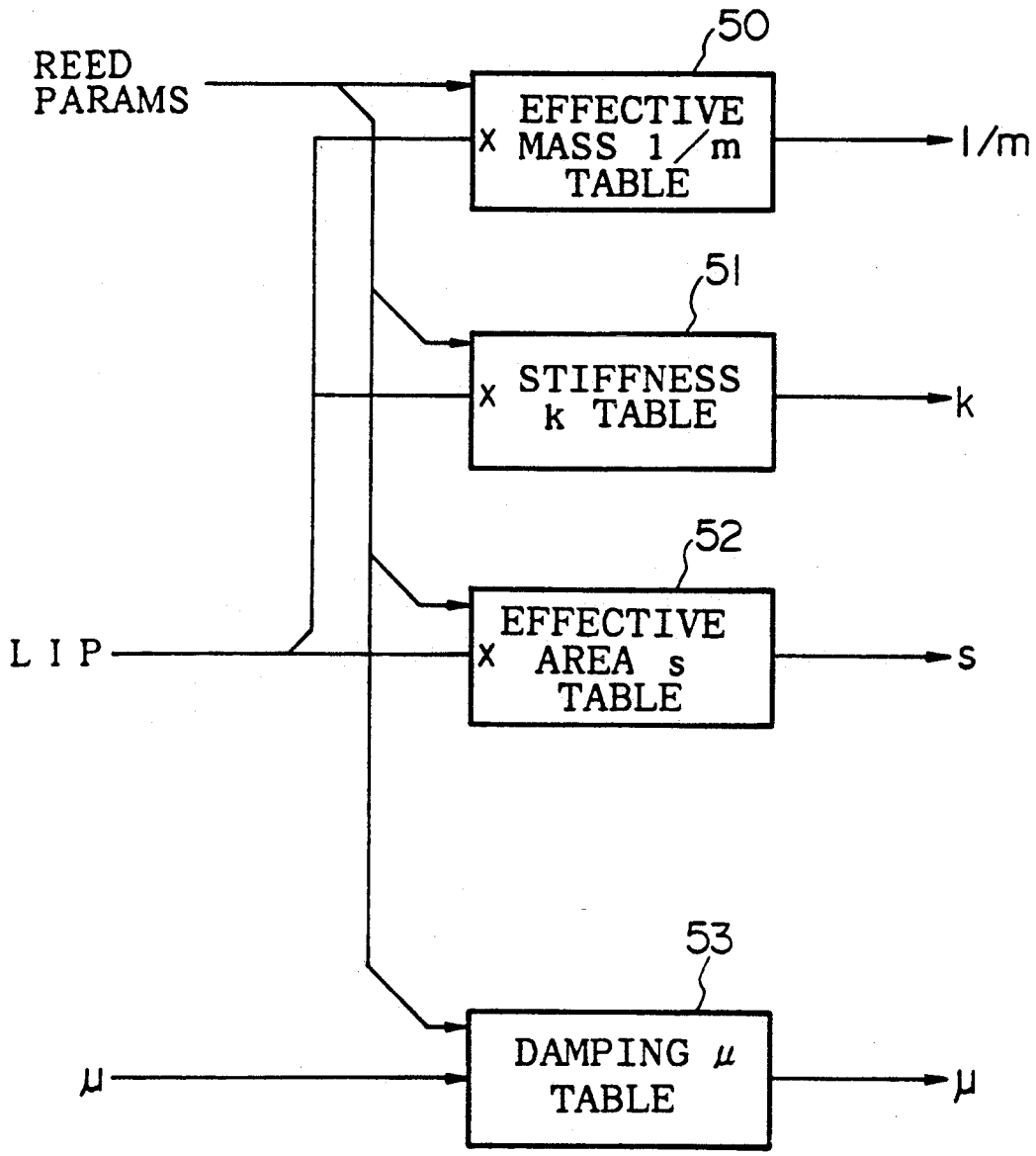
FIGS. 17 and 18 are block diagrams showing a detailed configuration of a filter shown in FIG. 6.
Figure 18:
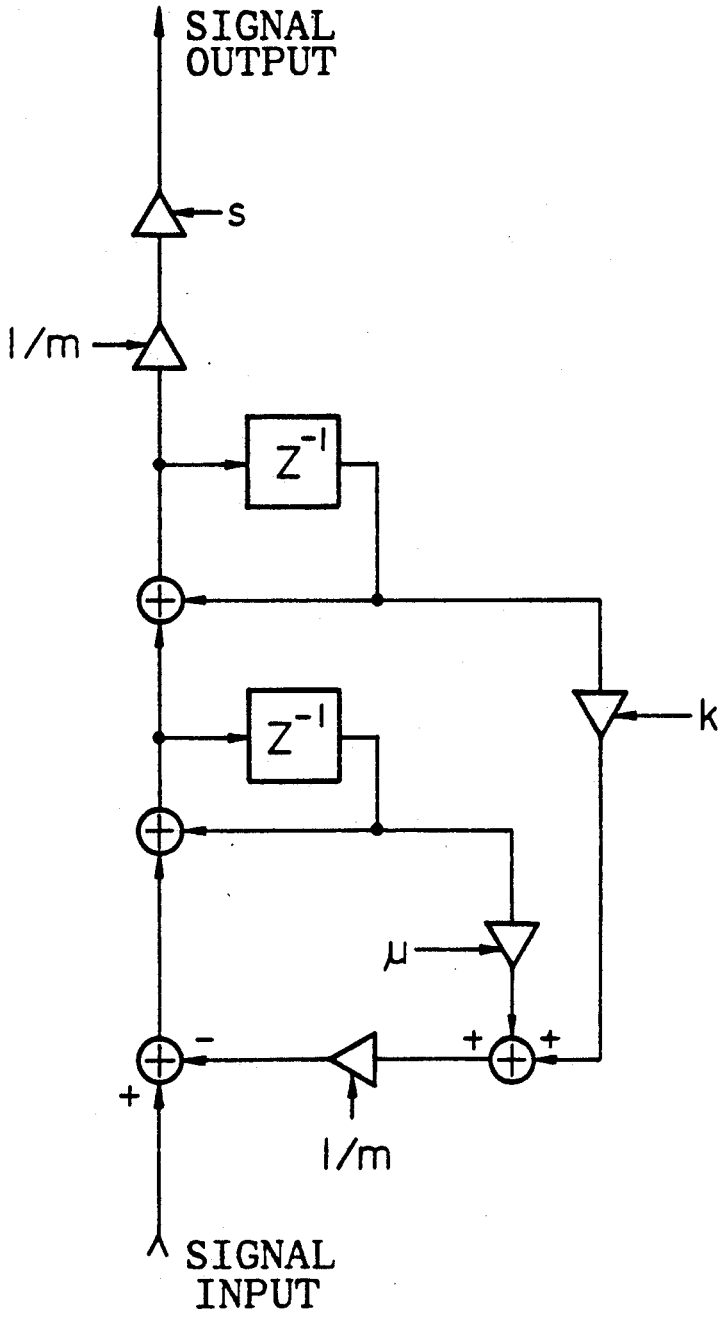

Next, description will be given with respect to the simulation of the reed. Since simulation processes of the read are basically similar to those of the tube, several kinds of setting processes are carried out with displaying their contents by the display unit 21 as shown in FIGS. 16A and 16B. In FIG. 16, reed widths W1, W2 are set, while thicknesses t1, t2 at points P1, P2 are set in order to show the cutting amount of the reed on the display screen. In addition, in FIG. 16C the stiffness representing the flexibility of the reed (i.e., spring constant) is set with respect to the position of the reed. Further, FIG. 16D the reed damping value representing the mechanical resistance of the reed is set in response to the signal EMBS. When completely setting some values concerning the shape of the reed, the parameters determining the reed characteristics are generated on the basis of these values. These parameters are generated as the signals "REED PARAMS". On the basis of these signals REED PARAMS, the contents of four tables shown in FIG. 17 are determined. Herein, an effective mass table 50 has the contents by which when the performer puts the reed in his mouth, mass corresponding to the part of the reed to be put in the mouth is obtained, whereby relationship between the effective mass and position of the lips is automatically set. Next, a stiffness table 51 has the contents by which the spring constant of the reed is set with respect to the position of the lips, while an effective area table 52 has the contents by which the area of the reed to be put in the mouth is automatically set with respect to the position of the lips. Further, a damping table 53 stores damping values of the reed, wherein these damping values correspond to the signal EMBS which responds to the biting intensity applied to the mouthpiece. Each of these tables 50, 51, 52 outputs its set value in response to the signal LIP which represents the position of the lips, so that the output value is supplied to the filter 30*a*. FIG. 18 shows the detailed configuration of this filter 30*a* (i.e., secondary digital filter), wherein parameters 1/m, k, s, $\mu$ respectively outputted from the tables 50, 51, 52, 53 are used as the coefficients of the multipliers. Under the above-mentioned processes for setting the parameters, it is possible to simulate the operations of the reed having the desirable shape.

As described above, even in the simulation of the reed, it is possible to automatically generate the parameters by visually setting the shape of the reed on the display screen. More specifically, the shape of the reed (i.e., three-dimensional shape) is edited so as to display it on the display screen; and the material of the reed is selected from the contents of the menu, containing flexible and hard materials, which is visually displayed. Thus, it is possible to automatically generate the parameters required for the simulation of the reed.

Thereafter, when the performance mode is selected after the above-mentioned parameters are memorized, the signals SLIP, SBR, SPB, SKON, SKOF are selected by operating the switches SWa to SWe shown in FIG. 4. Herein, the performer operates the keyboard 16 so as to read out the desirable one of the parameters stored in the memory circuit 20. As a result, the read parameters (see "REED PARAMS" in FIG. 6) are supplied to the tube simulating portion 40 and filter 30*a*, wherein several kinds of constants are determined.

Then, when the performer plays the tube-type performance input device 1 by blowing it so that the breath pressure exceeds certain value, the signal SKON is outputted, and the signal SBP corresponding to the breath pressure is outputted from the excitation parameter forming portion 11. In addition, this excitation parameter forming portion 11 also outputs the signal EMBS corresponding to the biting intensity of the mouthpiece M and the signal LIP corresponding to the position at which the mouthpiece M is put in the performer's mouth. Thus, it is possible to provide all of the signals which are required for the excitation-vibration circuit 30 performing the simulation of the mouthpiece. As a result, the signal forming portion 12 generates the musical tone signal corresponding to the tube to be simulated. In this case, the performance input device 1 outputs the keycode KC corresponding to the operation of the key switch 2 made by the performer, and consequently, the control portion 10 outputs the parameters corresponding to this keycode KC to the tube simulating portion 40. Thus, the musical tone signal outputted from the signal forming portion 12 can have the pitch corresponding to the performance to be actually played.

Incidentally, by use of the present embodiment, it is possible to design a wind-instrument-type electronic musical instrument which has not actually existed in the past. In addition, the present invention can be also applied to the improvement or brand-new design of the non-electronic musical instrument such as the clarinet.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument comprising:

a sound source means for generating a musical tone signal on the basis of a predetermined algorithm and parameters to be supplied thereto;

an input means for arbitrarily inputting a shape condition defining a shape of each portion of an instrument to be simulated;

a modifying means for modifying the inputted shape condition;

a display means for visually displaying at least one of the shapes corresponding to the inputted shape condition and the modified shape condition; and a parameter generating means for generating the parameters in response to the modified shape condition so as to supply the parameters to said sound source means.

2. An electronic musical instrument as defined in claim 1 wherein said input means is a manually operable device such as a keyboard, a mouse and the like.

3. An electronic musical instrument as defined in claim 1 wherein said instrument to be simulated is a wind instrument and the modified shape condition contains information corresponding to a tube shape, and position and size of a tone hole of the wind instrument.

4. An electronic musical instrument as defined in claim 1 wherein there are provided plural algorithms, each corresponding to a specific simulation manner for the shape of the instrument to be simulated, each of which is selectively used in said sound source means.

5. An electronic musical instrument as defined in claim 1 further providing a wind-instrument-type performance input device operable by a performer to input information corresponding to a performance so that said sound source means generates the musical tone signal corresponding to a sound of a wind instrument to be simulated.

6. An electronic musical instrument as defined in claim 1 wherein said instrument to be simulated is a wind instrument and a tube shape, such as a conical shape, of the wind instrument is divided into plural shapes each of which is simulated by another simple shape, such as a cylindrical shape.

7. A musical tone parameter generating device for electronic musical instruments which generate musical tone signals on the basis of parameters generated thereby, said device comprising:

an input means for arbitrarily inputting a shape condition defining a shape of each portion of an instrument to be simulated;

a modifying means for modifying the inputted shape condition;

a display means for visually displaying at least one of the shapes corresponding to the inputted shape condition and the modified shape condition; and a parameter generating means for generating the parameters in response to the modified shape condition so as to supply the parameters to an electronic musical instrument.

8. An electronic musical instrument as defined in claim 1 wherein said modifying means approximates the inputted shape condition to a shape condition corresponding to the parameters.

9. A musical tone parameter generating device as defined in claim 7 wherein said modifying means approximates the inputted shape condition to a shape condition corresponding to the parameters.

10. An electronic musical instrument as defined in claim 8 wherein the inputted shape condition is approximated by use of a cylindrical shape.

11. An electronic musical instrument as defined in claim 1 wherein the algorithm designates a procedure for generation of the musical tones by said sound source means, and the parameters provide values for use in said algorithm.

12. An electronic musical instrument as defined in claim 1 wherein the instrument to be simulated is a wind instrument, and the algorithm represents a configuration of a tube shape of the instrument wherein a shift register simulates the propagation delay of the air pressure wave in the tube shape, a junction simulates the scattering manner of the air pressure wave accompanied with the change of diameter of the tube, and a low pass filter simulates the energy loss caused by reflection of the air pressure wave with an end terminal portion of the tube, and wherein the parameters designate delay time and number of delay stages of the shift register and coefficients for the junction and the low pass filter.

13. An electronic musical instrument as defined in claim 1 wherein said instrument to be simulated is a wind instrument and the modified shape condition contains information corresponding to a reed shape and material density of the wind instrument.

* * * * *